US008696498B1

(12) United States Patent
Andrus

(10) Patent No.: US 8,696,498 B1
(45) Date of Patent: Apr. 15, 2014

(54) ARROW TRACKING DEVICE

(76) Inventor: Joseph Andrus, Geneva, OH (US)

( * ) Notice: Subject to any disclaimer, the term of this patent is extended or adjusted under 35 U.S.C. 154(b) by 0 days.

(21) Appl. No.: 13/536,298

(22) Filed: Jun. 28, 2012

(51) Int. Cl.
*F42B 6/04* (2006.01)

(52) U.S. Cl.
USPC ..... 473/578

(58) Field of Classification Search
USPC ..... 473/578, 585, 586
See application file for complete search history.

(56) References Cited

U.S. PATENT DOCUMENTS 3,417,994 A 12/1968 Rohrbaugh, Jr.
3,993,311 A 11/1976 Johnson
4,615,529 A 10/1986 Vocal
4,651,999 A 3/1987 Sturm
4,801,151 A 1/1989 Sturm et al.
4,836,557 A * 6/1989 Polando ..... 473/578
6,764,420 B2 * 7/2004 Cyr et al. ..... 473/578
7,909,714 B2 3/2011 Cyr et al.
8,157,679 B2 * 4/2012 Cyr et al. ..... 473/578

OTHER PUBLICATIONS

TurkeyHuntingSecrets.com. TrackMaster Electronic Arrow Tracking System. http://www.turkeyhuntingsecrets,.com/store/store-recovery-trackmaster-system.htm.

* cited by examiner

*Primary Examiner* — John Ricci
(74) *Attorney, Agent, or Firm* — Robert C. Montgomery; Montgomery Patent & Design

(57) ABSTRACT

An arrow tracking device and method of use provides archery arrows with a line tracking mechanism to aid in the location and retrieval after firing. The arrow is provided with a length of string housed inside the hollow arrow shaft. The string is attached at a first end to a nock assembly which is removably coupled to the arrow shaft behind the fletching. The string is attached at a second end to a wedge that is also housed within the arrow shaft behind the arrow head. The nock assembly includes a plurality of outwardly protruding barbs which attach to the animal at an entrance wound and does not pass through the animal with the arrow. If the animal and the arrow are separated, the length of string is deployed allowing a hunter to follow the string to the animal and locate the arrow.

16 Claims, 3 Drawing Sheets

ARROW TRACKING DEVICE

RELATED APPLICATIONS

Not Applicable.

FIELD OF THE INVENTION

The present invention relates generally to archery hunting, and in particular, to an arrow tracking device for enabling a bow hunter to track wounded game and fired arrows.

BACKGROUND OF THE INVENTION

When a bow hunter strikes his game, he is often faced with subsequent tracking of the animal as it can live for several hours after being hit, depending upon the accuracy of the hunter's shot. It is quite common while bow hunting for the arrow to pass completely through the game animal, whether it be deer, elk, or turkey. When this occurs, several things could happen. The game could run so far that the hunter never catches up to it or the wounded animal could be attacked by other wild animals, ruining the meat. Further problems occur where other hunters come upon the wounded game and claim it as their own. The difficulty in producing an accurate kill-shot with a bow increases the likelihood that it will not produce an instant kill, thus making tracking necessary. Furthermore, the problem of lost arrows is compounded in the situation where the hunter is hunting at dusk, dawn or in cloudy/foggy situations where visibility is limited. As arrows are becoming increasingly expensive, loss of an arrow can be very costly.

Various types of string tracking devices have attempted to address these problems. These devices typically include a string or cord attached at one (1) end to the bow and at another end to the arrow. When the arrow is fired, the string follows the flight path of the arrow and the hunter can follow it to find the arrow or the game. These devices create additional problems by slowing the speed of the arrow, thus making it less effective, and the string tending to get caught in trees or bushes making it ineffective and difficult to retrieve. Other devices include string tracking devices which are self-contained within the arrow and not attached to the bow. However, these devices are prone to failure and can directly impact the flight of the arrow. Additionally, these devices are ineffective if the arrow breaks upon impact with the animal.

SUMMARY OF THE INVENTION

The inventor has recognized the aforementioned inherent problems and lack in the art and observed that there is a need for an arrow tracking device that enables bow hunters to track their arrows and locate an injured or killed game animal. The development of the present invention substantially departs from the conventional solutions and in doing so fulfills this need.

In accordance with features and aspects of certain embodiments, the arrow tracking device for use with an arrow includes a nock assembly configured to be removably attached to a hollow rear end of an arrow shaft, a wedge configured to be inserted within a hollow front end of the arrow shaft behind an arrow head, and a length of string configured to be inserted within a hollow interior of the arrow shaft having a first end attached to the nock assembly and a second end attached to the wedge. The nock assembly catches and attaches to an object when the arrow entirely penetrates and passes through the object. The nock assembly detaches from the arrow shaft upon attachment to the object. The string deploys from the rear end of the arrow shaft when the nock assembly separates from the arrow shaft.

In accordance with other features and aspects of other embodiments, the nock assembly includes a nock feature disposed outside of the arrow shaft having a notch configured to receive a bow string, a friction collar opposite the nock feature configured to be inserted within the hollow rear end of the arrow shaft, and a plurality of barbs protruding outwardly from the nock feature at an angle directed toward the arrow head. The wedge is a generally cylindrical body having a second aperture at an end for attachment of the string second end. The friction collar is frictionally attached within the hollow rear end of the arrow shaft and the wedge is frictionally attached within the hollow front end of the arrow shaft.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
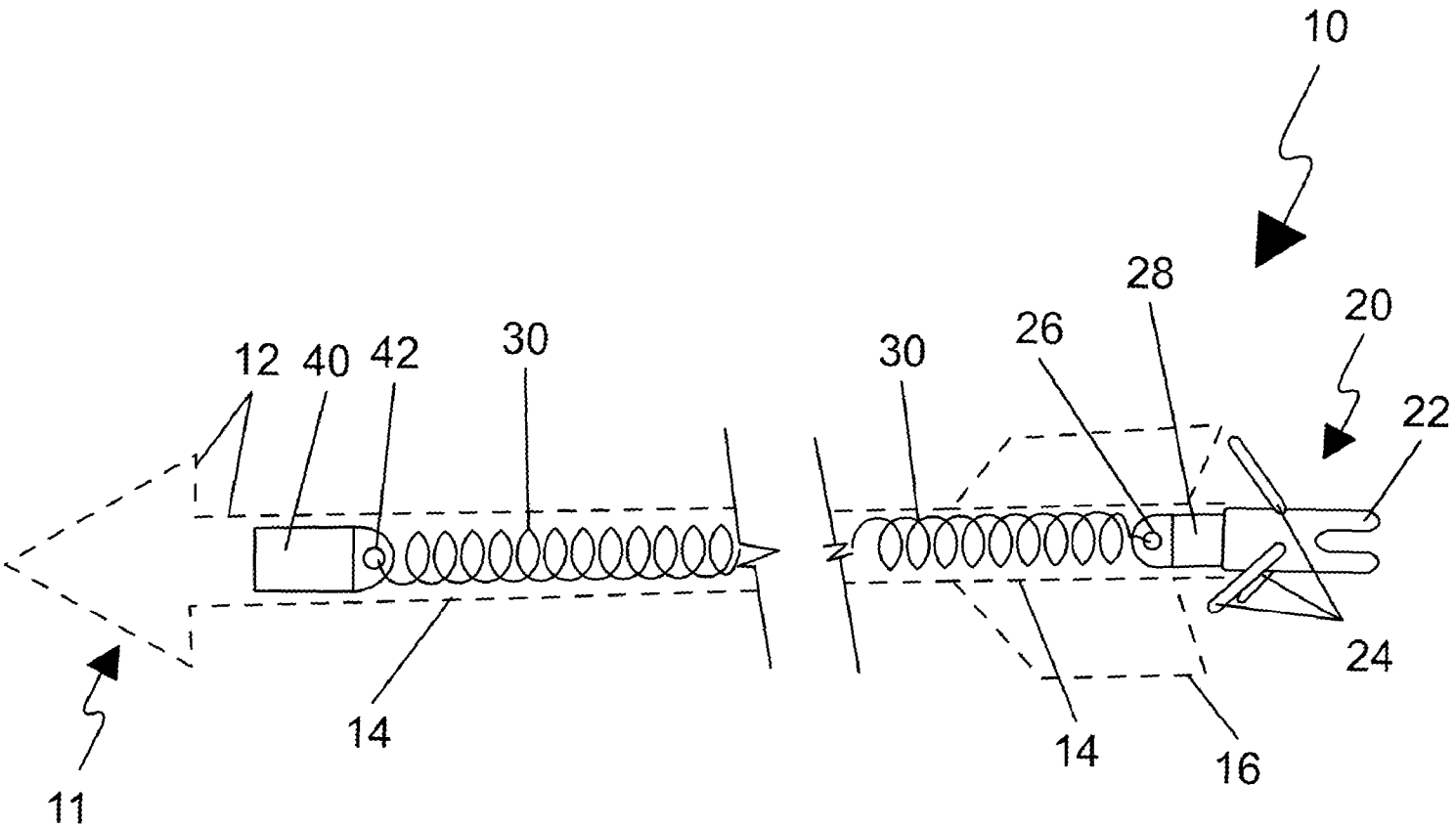
FIG. 1 is an environmental view of an arrow tracking device depicted within an arrow, in accordance with the present invention.

10 arrow tracking device
11 arrow
12 arrow head
14 arrow shaft
16 fletching
20 nock assembly
22 nock feature
24 barb feature
26 first aperture
28 friction collar
30 string
40 wedge
42 second aperture
50 string tube
60 push rod
62 handle
100 game animal
105 exit wound
110 hunter
120 bow
130 ground surface

DETAILED DESCRIPTION OF THE PREFERRED EMBODIMENT

Figure 2:
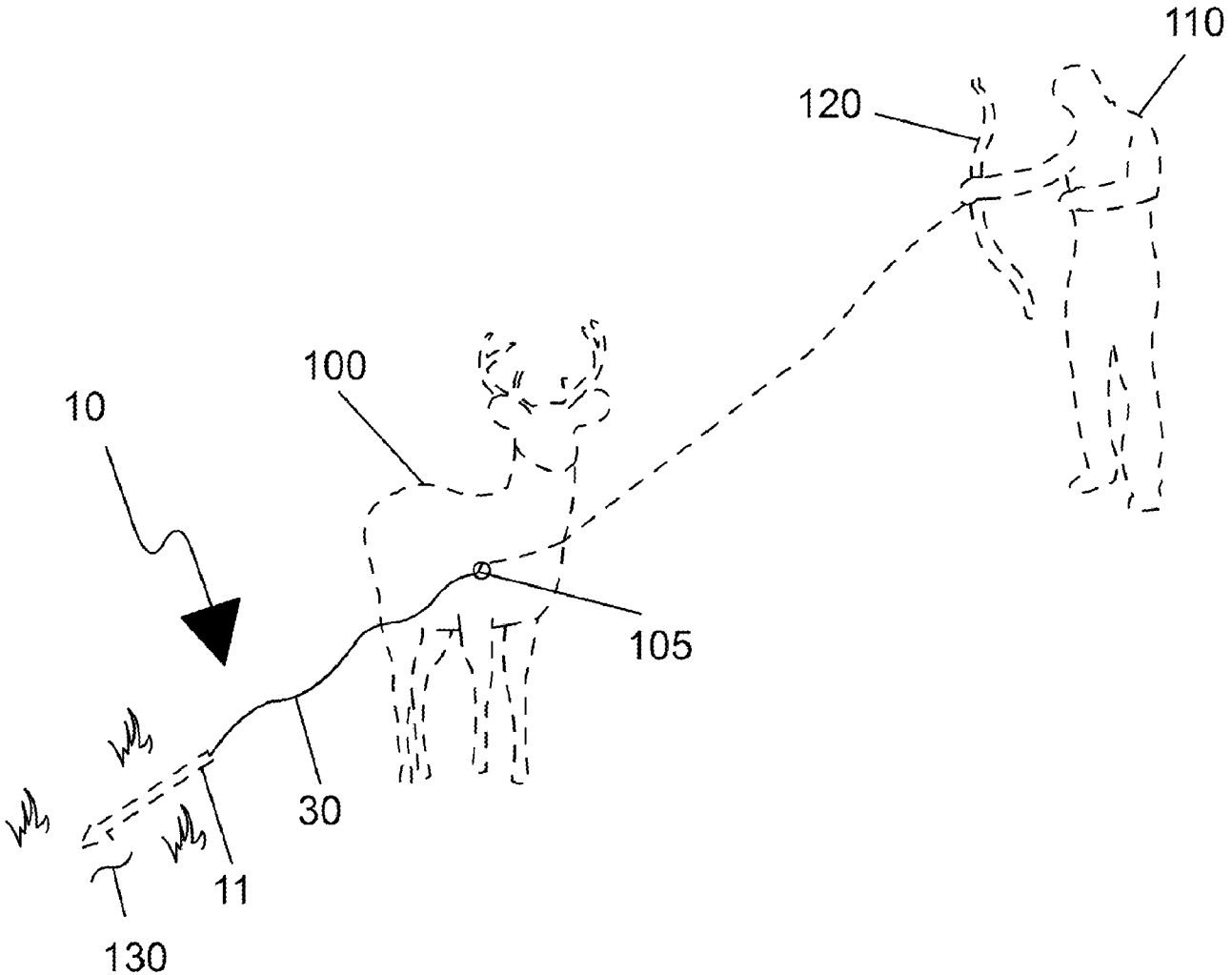
FIG. 2 is an environmental view of the arrow tracking device depicted in an in-use state; and, FIG. 3 is an exploded view of the arrow tracking device.
Figure 3:
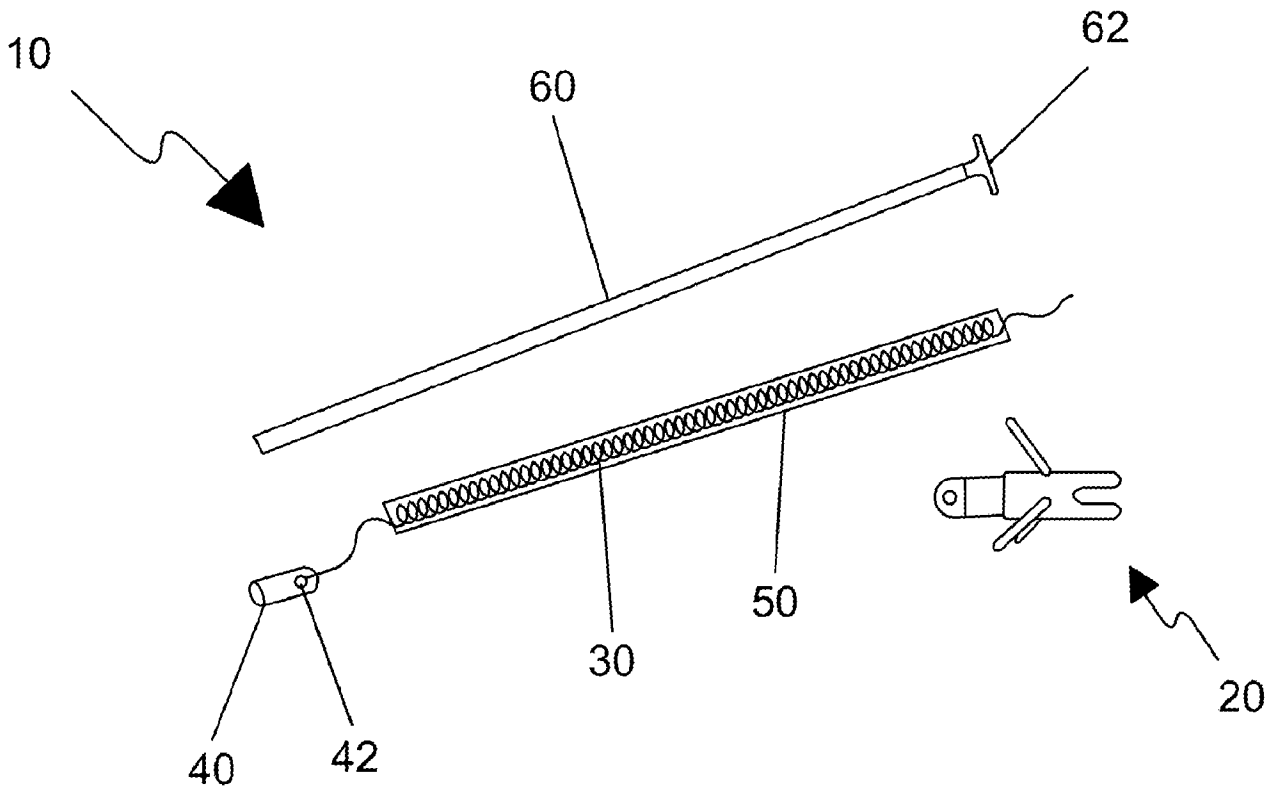

In accordance with the invention, the best mode is presented in terms of a preferred embodiment, herein depicted within FIGS. 1 through 3. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

It can be appreciated that, although such terms as first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 3, depicting a tracking device for an arrow, identified generally by reference to a device 10, where like reference numerals represent similar or like parts. In accordance with the teachings of the present disclosure, the device 10 provides a line-style tracking mechanism which is incorporated into an archery arrow 11 or similar bow fired projectile and configured to assist a hunter 110 in locating and retrieving the arrow 11 and tracking the game animal 100 after firing. The device 10 generally includes approximately one-thousand feet (1000 ft.) of coiled string 30 insertingly stowed within an arrow shaft 14 of the arrow 11. The string 30 is secured and housed within the shaft 14 and is outwardly deployed should the arrow break or pass through the game animal 100 during use.

Referring first to FIG. 1, the device 10 generally includes a nock assembly 20, a length of string 30, and a wedge 40. The nock assembly 20 is a unitary structure, preferably fabricated from molded plastic or a light weight metal, which emulates a conventional nock of an arrow 11. The nock assembly 20 includes a nock feature 22 a plurality of barb features 24, and a friction collar 28. When installing the device 10 within the arrow 11, the nock assembly 20 replaces the original nock of the arrow 11.

The nock feature 22 is an open notch disposed along a diameter of a rear end of the nock assembly 20 and is configured to receive the bowstring of the bow 120 having similar geometry as the conventional nock of the arrow 11. The nock assembly 20 is secured within a rear end of the hollow arrow shaft 14 by the friction collar 28 via a friction fit. The friction collar 28 includes an integrally molded first aperture 26 disposed on a forward edge for attachment of a proximal first end of the string 30. The first end of the string 30 is connected or otherwise attached to the first aperture 26 by any suitable fastening method, including tying, adhesives, mechanical fasteners, plastic welding, or the like.

The barb features 24 are each outwardly protruding barbs angled slightly forward from a vertical plane relative to the friction collar 28, at approximately thirty degrees (30°). The barbs are straight and can have a generally circular, square, triangular, or flat cross sectional shape. Each barb feature 24 has an affixed end that is affixed to the nock assembly 20 adjacent to the nock feature 22 and a free end which terminates in a sharp point. The three (3) barb features 24 are preferably equally spaced around the circumference of the nock assembly 20 and are aligned with the fletching 16 of the arrow 11 during installation. The outwardly protruding barb features 24 have approximately the same height as the fletching 16 to avoid unnecessary and negative aerodynamic effects during flight and maintain the normal accuracy of the arrow 11 when fired.

The wedge 40 is a cylindrical member, preferably fabricated from molded plastic or a light weight metal, inserted and retained within the hollow front end of the arrow shaft 14 adjacent to the arrowhead 12 by a friction fit. The wedge 40 includes an integrally molded second aperture 42 disposed on a rear edge for attachment of a distal second end of the string 30. The second end of the string 30 is connected or otherwise attached to the second aperture 42 by any suitable fastening method, including tying, adhesives, mechanical fasteners, plastic welding, or the like. The string 30 and wedge 40 are inserted and preloaded by the hunter 110 into the arrow shaft 14 using a push rod 60 (see FIG. 3) prior to insertion and installation of the nock assembly 20.

In situations where the arrow 11 breaks upon impact with the game animal 100, the arrow head 12 and the front end of the arrow 11 typically remains embedded within the body of the animal 100. The wedge 40 remains attached within the front end of the arrow shaft 14 and attached to the string 30. Therefore, even if the nock assembly 20 does not reach and attach to the animal 100, the device 10 operates as described herein enabling the hunter to track the animal 100 by following the string 30 from the broken portion of the arrow 11.

Referring next to FIG. 2, the device 10 is shown in use after the arrow 11 has bee fired at the game animal 100, such as a deer. The arrow 11 equipped with the device 10 is fired in a normal manner using the bow 120. During situations where the arrow 11 passes completely through the game animal 100, coincidental interference of the barb features 24 with the hide, surface, skin, or appendage of the animal 100, the nock assembly 20 attaches to the entry side of the wound and detaches from the arrow shaft 14. Subsequently the arrow 11 can graze of pass completely through the body of the animal 100 through an exit wound 105 and come to rest upon a ground surface 130. The arrow 11 remains connected to the nock assembly 20 by the string 30 from the wedge 40.

The string 30 is preferably made of a flexible, small diameter material such as, but not limited to; monofilament line, nylon line, cotton fibers, or the like. In certain embodiment, the string 30 can have a bright color such as red, orange, fluorescent colors, or the like to provide easy visual location by a hunter 110. Use of the device 10 assists the hunter 110 in location and retrieval of the arrow 11, as well as in tracking of the game animal 100 after shooting.

The friction collar 28 of the nock assembly 20 and the wedge 40 each have diameters in close tolerance with the inner bore diameter of the hollow arrow shaft 14 and are snugly secured by an interference fit-type attachment. In certain embodiment, the friction collar 28 and wedge 40 include molded-in features such as ribs, spherical protrusions, or the like on an exterior surface to insure a secure interference fit within the arrow shaft 14. It can be appreciated that the friction collar 28 of the nock assembly 20 and wedge 40 can be introduced having various diameters corresponding to inner diameters and the nock feature 22 of the nock assembly 20 can be introduced having various diameters corresponding to outer diameters of different models of arrows 11.

It can be appreciated that in certain embodiments, the present device 10 also includes the arrow 11 or similar fired projectile. In such embodiments, the device 10 includes the features as previously described, including the nock assembly 20, the string 30, and the wedge 40 housed within a hollow arrow shaft 14. The arrow 11 includes an arrow head 12 affixed to a forward end and the nock assembly 20 removably coupled to a rear hollow nock end opposite the arrow head 12 behind fletching 16. The fletching 16 is affixed to the exterior of e rear end of the arrow shaft 14 in a conventional manner.

Referring finally to FIG. 3, which illustrates the device 10 in an exploded view depicting an arrangement prior to installation within the arrow shaft 14. In certain embodiments, the string 30 is preferably pre-packaged within a string tube 50. The string tube 50 is a thin-walled, cylindrical structure having an outer diameter suitably sized to allow snug insertion into the arrow shaft 14. Prior to loading the string 30 into the arrow shaft 14, the distal, second end of the string 30 is attached to the second aperture 42 of the wedge 40. After removing the original nock from a nock end of the shaft 14, the wedge 40 is inserted into the arrow shaft 14 and driven down the length of the shaft 14 toward the arrow head 12 using the push rod 60. The string tube 50 is inserted within the open nock end of the arrow shaft 14 and the push rod 60 is used to press the string 30 out from the string tube 50 and into the arrow shaft 14. The proximal, first end of the string 30 is attached to the first aperture 26 of the nock assembly and the friction collar 28 is pressingly inserted into the open nock end of the arrow shaft 14 such that the barb features 24 are aligned with the fletching 16.

The push rod 60 is a cylindrical structure, preferably made of a light weight and rigid material, such as metal or plastic. The push rod 60 is approximately the same length as the arrow shaft 14 having a diameter slightly less than the inner diameter of the string tube 50. In certain embodiments, the push rod 60 also includes a T-shaped handle 62 to improve gripping and grasping ergonomics for smooth and straight insertion into the string tube 50 during loading of the string 30 within the arrow shaft 14 by the hunter 110.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the device 10 can be utilized by the user in a simple and effortless manner with little or no training in general accordance with FIG. 1 through FIG. 3. It can be appreciated that the steps required to utilize the device 10, as described, can performed in alternative order and as such should not be viewed as a limiting factor.

Prior to use, the hunter 110 or other user procures a model of the device 10 with nock assembly 20 and wedge 40 having an appropriately and suitably sized length and diameter which corresponds to a specific arrow shaft 14. The original nock of the arrow 11 is removed from the nock end. The second end of the string 30 is attached to the wedge 40 and the wedge 40 is inserted into the open nock end of the shaft 14. The wedge 40 is pressed downward with the push rod 60 into a forward end of the arrow shaft 14. The string tube 50 is inserted into a nock end of the arrow shaft 14 and the coiled string 30 is pushed out from the string tube 50 and into the hollow arrow shaft 14 by inserting the push rod 60 into a top of the string tube 50. The push rod 60 and string tube 50 are removed from the shaft 14. The first end of the string 30 is attached to the first aperture 26 of the nock assembly 20. The friction collar 28 of the nock assembly 20 is manually pressed into the nock end of the arrow shaft 14.

During use of device 10, the arrow 11, equipped with the device 10, is fired at the identified animal 100 in a normal manner. In situations where the arrow 11 passes through a part of the body of the animal 100 and comes to rest upon the ground surface 130, the barb features 24 of the nock assembly 20 pierce the skin of the animal and attach to the entry wound created by the arrow 11. As the arrow 11 continues its flight or as the animal 100 moves away from the arrow 11, the string 30 is deployed between the animal 100 and the arrow 11. The hunter 110 utilizes the bright color of the string 30 to aid in the location and retrieval of the arrow 11 or tracking of the wounded animal 100. This process is repeated as necessary using additional arrows 11 equipped with the device 10.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. An arrow tracking device for use with an arrow comprising:

a nock assembly configured to be removably attached to a hollow rear end of an arrow shaft, further comprising:

a nock feature disposed outside of said arrow shaft comprising a notch configured to receive a bow string;

a friction collar configured to be frictionally inserted within said hollow rear end of said arrow shaft opposite said nock feature; and, a plurality of barbs protruding outwardly from said nock feature at an angle directed toward an arrow head;

a wedge configured to be inserted within a hollow front end of said arrow shaft behind said arrow head; and, a length of string configured to be inserted within a hollow interior of said arrow shaft having a first end attached to said nock assembly and a second end attached to said wedge;

wherein said friction collar comprises a first aperture at an end opposite said nock feature for attachment of said string first end;

wherein said nock assembly catches and attaches to an object when said arrow entirely penetrates and passes through said object;

wherein said nock assembly detaches from said arrow shaft upon attachment to said object; and, wherein said string deploys from said rear end of said arrow shaft when said nock assembly separates from said front end of said arrow shaft.

2. The device of claim 1, wherein each of plurality of barbs terminates at a sharp point.

3. The device of claim 1, wherein said wedge comprises a generally cylindrical body and a second aperture at an end for attachment of said string second end;

wherein said wedge is frictionally attached within said hollow front end of said arrow shaft.

4. The device of claim 1, wherein said string comprises a brightly colored material.

5. The device of claim 1, further comprising a push rod for driving said wedge and said string within said arrow shaft.

6. The device of claim 1, wherein said string is initially disposed within a hollow tube prior to insertion within said arrow shaft.

7. The device of claim 1, wherein said nock assembly comprises:

a nock feature disposed outside of said arrow shaft comprising a notch configured to receive a bow string;

a friction collar opposite said nock feature configured to be inserted within said hollow rear end of said arrow shaft and comprising first aperture for attachment of said string first end; and, three barbs protruding outwardly from said nock feature at an angle directed toward said arrow head and adapted to align with arrow fletching of said arrow.

8. The device of claim 7, wherein said wedge comprises a generally cylindrical body and a second aperture for attachment of said string second end.

9. The device of claim 8, wherein said friction collar is frictionally attached within said hollow rear end of said arrow shaft and wherein said wedge is frictionally attached within said hollow front end of said arrow shaft.

10. The device of claim 9, wherein each of plurality of barbs terminates at a sharp point.

11. The device of claim 10, wherein said string comprises a brightly colored material.

12. The device of claim 11, further comprising a push rod for driving said wedge and said string within said arrow shaft.

13. The device of claim 12, wherein said string is initially disposed within a hollow tube prior to insertion within said arrow shaft.

14. An arrow tracking device comprising:

an arrow comprising a hollow arrow shaft, an arrow head affixed to a front end, fletching affixed to a rear end, and a hollow interior;

a nock assembly removably attached to a hollow rear end of said arrow shaft, further comprising:

a nock feature disposed outside of said arrow shaft comprising a notch configured to receive a bow string;

a friction collar opposite said nock feature inserted within said hollow rear end of said arrow shaft and comprising a first aperture; and, three barbs protruding outwardly from said nock feature at an angle directed toward said arrow head terminating at a sharp point and adapted to align with said fletching of said arrow;

a wedge disposed within a hollow front end of said arrow shaft behind said arrow head; and, a length of string disposed within said hollow interior of said arrow shaft having a first end attached to said nock assembly and a second end attached to said wedge;

wherein said first aperture provides an attachment of said string first end;

wherein said nock assembly catches and attaches to an object when said arrow entirely penetrates and passes through said object;

wherein said nock assembly detaches from said arrow shaft upon attachment to said object; and, wherein said string deploys from said rear end of said arrow shaft when said nock assembly separates from said arrow shaft.

15. The device of claim 14, wherein said wedge comprises a generally cylindrical body and a second aperture for attachment of said string second end.

16. The device of claim 15, wherein said friction collar is frictionally attached within said hollow rear end of said arrow shaft and wherein said wedge is frictionally attached within said hollow front end of said arrow shaft.

* * * * *